United States Patent [19]

Swenson

[11] 3,992,032

[45] Nov. 16, 1976

[54] ADJUSTABLE RELEASE SKI BINDING

[76] Inventor: Glen R. Swenson, 3152 Valley, Salt Lake City, Utah 84109

[22] Filed: Apr. 25, 1975

[21] Appl. No.: 571,513

[52] U.S. Cl. ..... 280/632
[51] Int. Cl.[2] ..... A63C 9/08
[58] Field of Search ..... 280/11.35 T

[56] References Cited

UNITED STATES PATENTS

| | | | |
|---|---|---|---|
| 2,745,672 | 5/1956 | Meier | 280/11.35 T |
| 2,777,705 | 1/1957 | Goodman | 280/11.35 T |
| 3,241,849 | 3/1966 | Bodycomb | 280/11.35 T |
| 3,504,922 | 4/1970 | Wiley | 280/11.35 T |

*Primary Examiner*—Robert R. Song
*Attorney, Agent, or Firm*—K. S. Cornaby

[57] ABSTRACT

An adjustable release ski boot binding is provided for holding a ski boot attached to the surface of a snow ski while skiing. The binding is adapted to permit the toe of the ski boot to pivot laterally and/or vertically out of the binding should a predetermined torque force be applied in that direction; as during a fall by a skier utilizing the binding. Individual spring-loaded components of the binding are provided for restricting movement of the ski boot toe in lateral and vertical planes. The compression force of each spring is adjustable to provide different release capabilities for accommodating different skiing styles, and skier weights. In a preferred embodiment, the spring-loaded components for restricting lateral pivoting of the ski boot out of the binding reset automatically after the displacing torque has been removed.

10 Claims, 8 Drawing Figures

Figure 7:
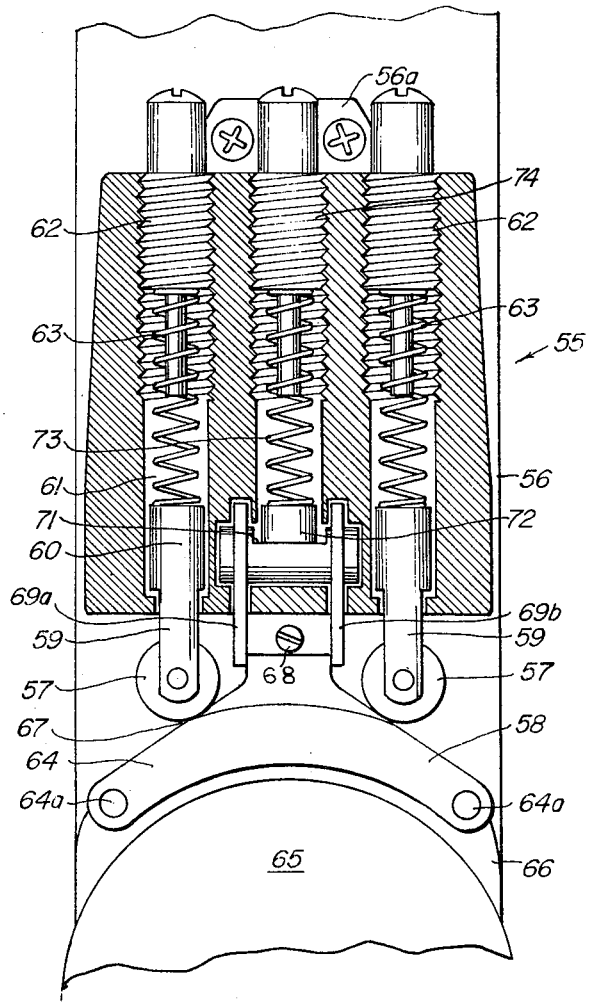

FIG. 1.
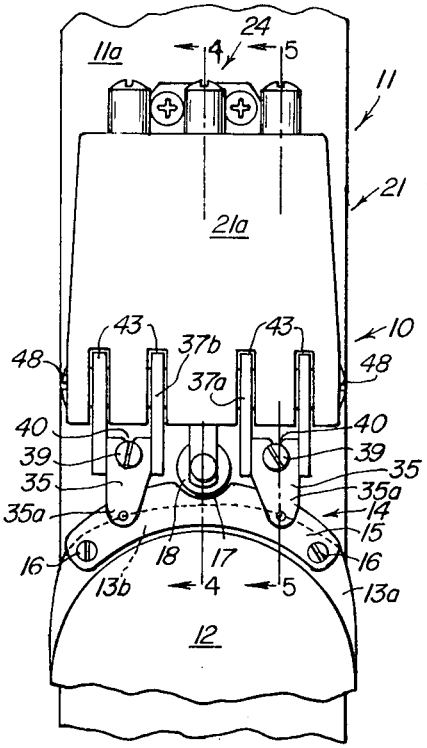
FIG. 2.
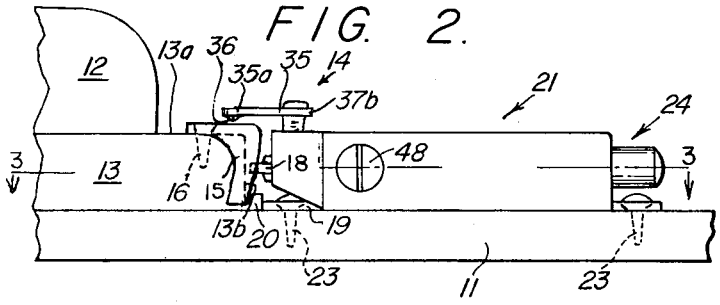
FIG. 4.
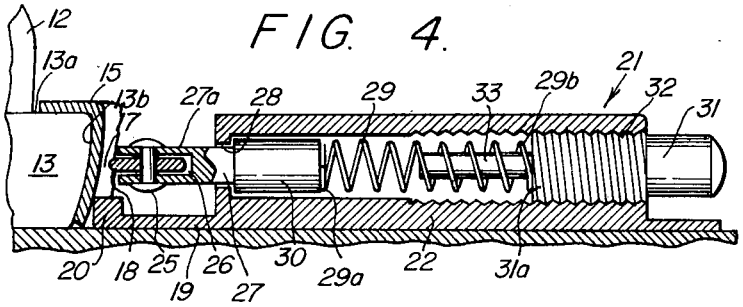
FIG. 5.
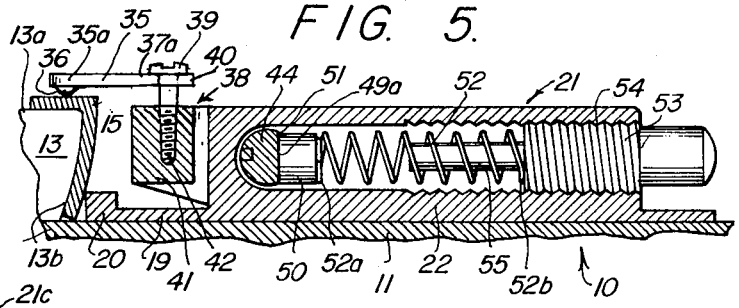
FIG. 6.
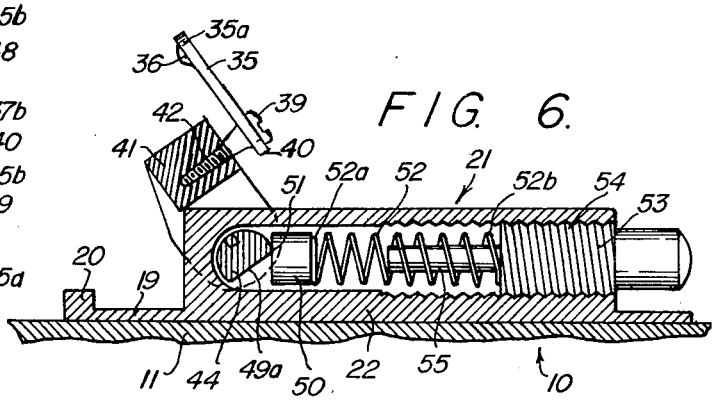
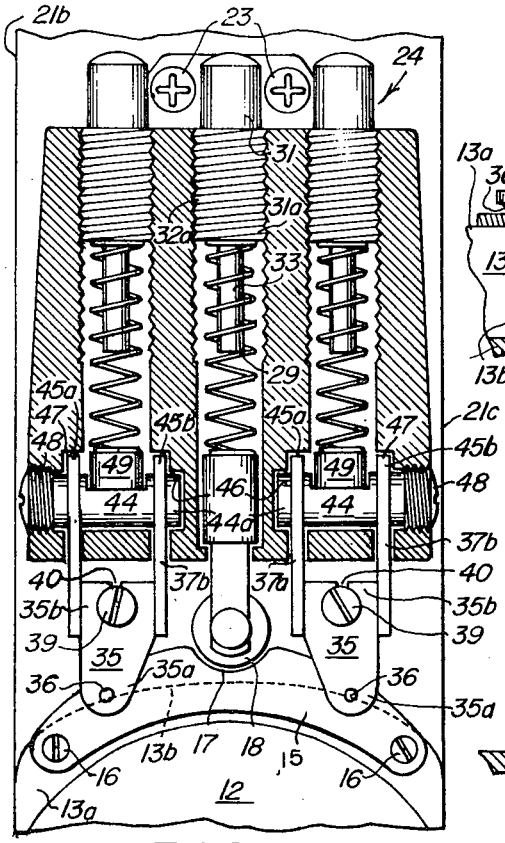
FIG. 3.

ADJUSTABLE RELEASE SKI BINDING

FIELD OF THE INVENTION

This invention relates to ski boot bindings for maintaining a ski boot on a snow ski.

PRIOR ART

With the increased popularity the sport of skiing has enjoyed in recent years has come a proliferation of ski bindings. These bindings share a common objective of holding a ski boot to the surface of a ski while the ski is being used in safe skiing activities. The bindings are intended to release the ski boot when a certain predetermined torque force is applied against the binding, as when a skier falls.

The present invention, like the prior art bindings, is intended to release a ski boot from the ski when a predetermined amount of torque is applied to the binding. Many ski boot toe bindings, like those shown in U.S. Pat. Nos. 3,638,958, and 3,638,959, incorporate pivoting jaw arrangements for holding a ski boot toe to the surface of a ski. Such arrangements, like the present invention, are intended for use in combination with means for holding the heel of the ski boot in place on the ski surface. The prior art bindings are capable of allowing the boot toe to rotate laterally out of engagement with the binding when a side torque is applied. The binding of the present invention provides for an adjustable lateral rotational release, but also provides adjustable means for affecting a vertical release of the boot toe with the presence of a vertically applied force. None of the prior art bindings provides individually adjustable means for both vertical and lateral release of the boot from the binding.

SUMMARY OF THE INVENTION

It is a principal object of the present invention to provide an adjustable release binding for mounting on a conventional snow ski, which binding is capable of holding the toe of a ski boot on the ski during normal skiing activities, but which will release the boot when either a predetermined torque force is directed on the boot to move the toe laterally across the ski, or a predetermined torque force is exerted on the boot to move it vertically away from the toe binding, or a combination of such torque force is exerted to move the boot in any directional vector between vertical and lateral directions.

Principal features of the present invention include a housing arranged to be permanently attached to a top surface of a conventional snow ski, preferably by screws or like attachment means. Extending from an end of the housing and intended to receive the toe of a ski boot thereagainst, is arranged a plunger adapted for reciprocal motion within the housing and having means such as a roller mounted on the toe end thereof. The roller means is journalled to the plunger end, the plane of the roller being parallel to the ski surface, and is adapted to rest against the toe of the ski boot, preferably in a notch formed in the end of the boot sole.

The end of the plunger opposite the roller terminates within the housing in a piston means. The piston means is arranged to slide reciprocally within the housing. Spring means, such as a helical spring, rests against the piston end so as to urge the piston and plunger forward of the housing. Adjustable tension means, such as a compression screw in contact with the housing is arranged at the opposite end of the spring means, which is thereby compressed between the piston and compression screw faces so as to urge the plunger outwardly from the housing end. The roller attached to the plunger is thereby urged preferably into the ski boot notch. Upon application of a lateral torque force, as by a fall or the like, tending to move the boot laterally across the ski, the roller and plunger would thereby be forced into the housing against the biasing of the spring means, and the boot would move across the roller, releasing the ski boot from the ski.

While one roller and plunger arrangement centrally fitted into the housing is a preferred arrangement for the present invention, two such plunger and roller combinations functioning as described above, but arranged parallel to each other within said housing proximate to the sides thereof and abutting each side of the boot toe, substituted for the described single roller arrangement, without departing from the subject matter coming within the scope of this invention. In order to provide for boot release should a vertical torque tending to lift the ski boot toe be applied, single or double toe clamps are included. The toe clamps are arranged to fit over the sole of the ski boot toe, restraining vertical movement thereof. The preferred pair of clamps are arranged parallel to each other preferably on either side of the centrally disposed roller piston described above, and terminate in pivot means journaled within the housing, pivoting separately so as to allow the respective clamps to pivot upwardly individually.

Each pivot means has preferably a central notch removed therefrom on its surface opposite to the clamp, which notch receives a face of a piston fitted therein. The individual piston is arranged to reciprocate within said housing and has spring means such as a helical spring abutting the opposite face thereof. The opposite end of each spring means in turn abuts the face of adjustable tension-producing means, such as a compression screw, in contact with the housing. The compressive force exerted on said piston being adjustable by appropriately rotating the compression screw into or out of the housing.

An upward lifting force or torque applied by the ski boot against the pair of toe clamps will tend to rotate the individual pivot. So arranged, the surface of the notch of each pivot will move downwardly over the face of the piston to force each piston away therefrom and compress the spring means. The amount of torque applied by the boot to overcome the spring tension is determined by the amount of pressure exerted on the spring means by the compression screw, which is adjustable. As the vertical force is applied by the boot toe, each helical spring is thereby further compressed until the top edge of the notch passes over the piston face, forcing the piston to move back against the pivot surface above the notch to lock the particular clamp in an upwardly rotated attitude. Thereafter, to reset the clamps to a normal ski boot holding attitude, a downward force, as by a skier stepping on the top of the clamps, is exerted thereagainst. This force causes the pivots to rotate such that each notch travels back of the piston face, the helical spring being compressed until the piston face has moved back to its normal abutting attitude against the notch.

If desired, a single vertical toe clamp can be disposed centrally of the housing and boot toe, with a pair of roller members as described above disposed on either lateral side of the toe clamp to provide resistance against lateral movement of the boot. The compression force of the spring means for either the vertical toe clamp or lateral roller means of the present invention can be adjusted by appropriately rotating each of the tension adjusting means, such as compression screws, that are arranged in the housing. The compression applied thereby to each spring means applies a given, predetermined force against the boot sole through the respective toe clamps and roller means so that when certain horizontal and vertical torque forces are applied by the ski boot the binding will release the boot.

Further objects and features of the invention will become apparent from the following detailed description, taken together with the accompanying drawings.

THE DRAWINGS

Figure 8:
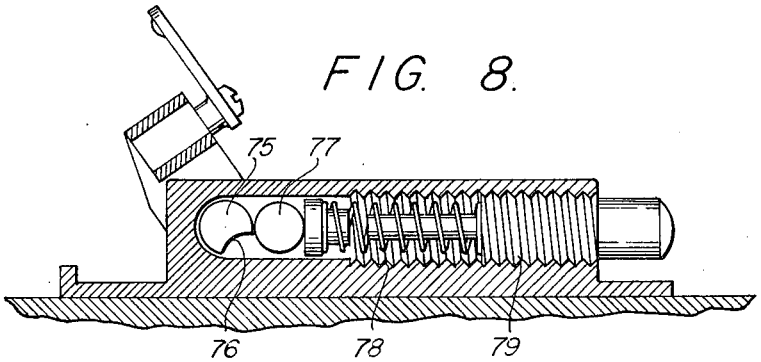

The best mode for presently carrying out the invention is illustrated in the accompanying drawing, in which:

FIG. 1, is a top plan view of an adjustable release binding of the present invention shown installed onto the surface of a conventional snow ski and having a toe portion of a conventional ski boot fitted thereto;

FIG. 2, a side elevational view of the adjustable release binding of FIG. 1, showing in broken lines screw means installing said binding to the ski, and screw means installing an optional toe plate to the toe of the sole of the ski boot;

FIG. 3, a top plan sectional view taken along the line 3 — 3 of FIG. 2, showing a top plan view of the interior of the adjustable release binding of FIG. 1;

FIG. 4, a side elevational sectional view taken along the line 4 — 4 of FIG. 1, showing an arrangement of a plunger and roller portion of the binding;

FIG. 5, a side elevational sectional view taken along the line 5 — 5 of FIG. 1, showing an arrangement of a clamp portion of the binding;

FIG. 6, a side elevation sectional view similar to FIG. 5, showing the clamp portion thereof pivoted to a release attitude;

FIG. 7, a top plan sectional view of a second embodiment of the present invention having a top section of a housing portion thereof removed to expose the binding interior; and FIG. 8, a side elevation sectional view of yet another embodiment of the invention, showing an alternative arrangement of the pivot means and piston means in the toe clamp assembly.

DETAILED DESCRIPTIONS OF THE ILLUSTRATED EMBODIMENTS

As shown in FIG. 1 of the drawings, a first embodiment of an adjustable release binding 10 of the present invention is secured to a top surface 11*a* of a section of a conventional snow ski 11. Shown also as a partial section in FIG. 1 is the toe of a ski 12, having the boot sole 13 abutting the boot-engaging portion 14 of binding 10. Shown best in FIGS. 2, 4 and 5, the sole 13 of boot 12, has an optional toe plate 15 secured over the upper edge 13*a* of the sole and extending downwardly over the face 13*b* of the sole. Toe plate 15, as shown best in FIGS. 1 through 3, is secured to the boot sole 13 by screws 16. The toe plate 15 has a curved notch 17 formed in the midpoint thereof for receiving a roller 18 that is preferably fabricated from a somewhat resilient material, such as hard rubber, the function of which will be explained in detail later herein.

With toe plate 15 installed as described on the boot sole 13, the boot heel, not shown, is held to the ski by means not shown, so as to force the toe plate against an upturned lip 20 of a kick plate 19, FIGS. 4 and 5. The kick plate 19, as shown best in FIGS. 4 through 6, is arranged to extend from, and in plane of, a base 22 of a housing 21 of the binding 10 and forms preferrably a part of base 22. The binding housing 21 is attached to the surface of ski 11 by means of screws 23, FIGS. 1 through 3. The purpose of the binding 10 is to maintain boot 12 on ski 11 during normal skiing operations, and to provide release of that boot should certain torque forces be applied against the boot. This described attachment of boot to ski is effected by roller 18 being urged into engagement with notch 17 in toe plae 15. Roller 18 provides resistance against lateral movement of boot 12 from its predetermined position on the surface of ski 11 during normal skiing activities. Roller 18, as shown best in FIG. 4, is attached axially to a plunger 27 by a pin 25 so as to rotate within a notch 26 formed in an end 27*a* of plunger 27. So arranged, the plane of rotation of the roller 18, within the notch 26, is across the plunger 27*a*, in the plane of the plunger, and parallel to plane of the top 11a of the ski. Plunger 27, shown best in FIG. 4, is arranged in an opening 28 formed in the boot engaging portion 14 of the binding housing 21, sliding freely in and out thereof. To provide the necessary biasing force to maintain roller 18 snugly against the surface of the notch 17 during normal skiing activities, a helical spring 29 is provided that is compressed within housing 21. One end 29*a* of the helical spring, FIG. 4, is arranged to butt against an end of a piston 30 that is attached to the end 27*b* of the plunger 27. The compressive force exerted by the helical spring 29 on the piston end is, in turn, adjusted by turning appropriately a compression screw 31 that is seated in a threaded opening 32 in the end portion 24 of the binding housing 21. Shown best in FIGS. 3 and 4, on an end 31*a* of the compression screw 31 is attached a spring guide 33 extending longitudinally into the helical spring 29, through an end 29*b* thereof. The spring guide 33 provides a means for preventing horizontal deflection of the helical spring during compression thereof, maintaining such spring compression in a straight line between the spring ends 29*a* and 29*b*. A groove, not shown, intended to accommodate a screw driver, or the like, is preferrably formed across an end 31*b* of the compression screw 31 that extends from the binding housing 21. An operator, not shown, by turning the compression screw appropriately can thereby move the compression screw into or out of the binding housing to adjust the compressive force which the helical spring 29 exerts on the face of the piston 30. The compressive force exerted against said piston 30 is, of course, transferred through the plunger 27 and into the roller 18, exerting a force therethrough that has to be overcome by a lateral torque applied by the surface of the notch 17, thereby causing it to travel over the roller to release the boot 12 from the ski 11.

The binding 10, described thus far, is capable of maintaining a ski boot to a ski during normal skiing operations, and to release when a sufficient lateral torque is applied to the boot.

Shown best in FIGS. 1 through 5, the preferred means for restraining boot 12 from lifting vertically out of the binding involves a pair of toe clamps 35 that are arranged along both sides of the described roller 18 and plunger 27. Shown in the above-mentioned figures, each toe clamp 35 is preferrably fabricated from metal as a flat tab somewhat triangular shape whose apex is rounded and is arranged to extend outwardly from the binding housing 21 such that the apex end 35*a* thereof extends over the toe plate 15 when boot 12 is in place on ski 11. Each such apex end 35*a* has a node 36 formed thereon that projects downwardly from that end to just contact the top of said toe plate. The opposite end 35*b* of each toe clamp 35 is formed so as to fit closely between parallel side walls 37*a* and 37*b* of pivot 38. The snug fit of the toe clamp 35 between the side walls 37*a* and 37*b* prevents horizontal rotation thereof, while allowing the toe clamp to be moved vertically. Such vertical displacement provides a means for adjusting the height of the apex end 35*a* above a boot sole to accommodate most dimensions of boot soles. A screw 39 is fitted through a notch opening 40 to turn freely therein, and is turned into an appropriately threaded hole 42 in a pier 41, between the side walls 37*a* and 37*b* to provide the means for establishing the height of said apex end 35*a*. An operator, now shown, by turning the screw 39 moves a collar portion, not shown, on which the edge of the notch opening 40 rides, to elevate toe clamp end 35*b*.

Shown best in FIGS. 1, the side walls 37*a* and 37*b* extend parallel to one another into notches 43 formed in a top plate 21*a* of the binding housing 21. Shown best in FIG. 3, wherein the top plate 21 has been removed from the binding housing 21, pivots 44 are installed through and secured to ends 5*a* and 45*b* of the side walls 37*a* and 37*b* by means, not shown. Said pivots 44, once installed to the side wall ends 45*a* and 45*b*, have ends 44*a* thereof seated in cavities 46 that are formed with the housing 21 and are on line with and across from one another but are separated by the described roller plunger 27 and piston 30. The pivot ends 44*a* are thereby arranged to rotate freely in the cavities 46. The opposite side walls 21*b* and 21*c* of the binding housing 21 to rotate freely thereon. Shown best in FIG. 3, the openings 47 are partially threaded and each has a retention screw 48 turned therein to retain the pivots 44. The pivots 44 are pivotally maintained so as to be capable of rotating to move the attached side walls of toe clamps 35 between a horizontal attitude of FIG. 5 and a vertical attitude of FIG. 6.

As shown in FIG. 3, each pivot 44 is centrally notched at 49, forming thereby a flat face 49*a* centrally thereon, FIGS. 5 and 6, against which face one end of a piston 50 is arranged to butt. With the piston 50 end butting against the notch 49 flat face 49*a* the particular toe clamp 35 lies parallel to the ski 11, above the toe plate 15. Should however a rotational torque be applied so as to rotate upwardly the toe plate and pivot 44, the pivot will turn so that a top edge 51 of flat face 49*a* displaces piston 50 towards the housing end portion 24, the toe clamp rotating upwardly thereby to the attitude shown in FIG. 6. In which attitude, shown in FIG. 6, the top edge 51 of the flat face 49*a* has turned past the end of piston 50, the piston thereafter moving back over part of the pivot 44 above the top edge 51. To reset the pivot to the attitude of FIG. 5*a* a downward rotational torque must be applied against the toe clamp 35 to again rotate the pivot top edge 51 along the piston 50 past the face until the toe clamp 35 attitude of FIG. 5 is reestablished.

A preferred force for each piston 50 consists of a helical spring 52, that is similar to and functions like the helical spring 33 already described herein. A leading end 52*a* of each helical spring 52 is arranged in contact with the side of piston 50 opposite to its contact face with the pivot notch 49. A trailing end 52*b* of each helical spring 52, shown in FIGS. 5 and 6, is in contact with a face of a compression screw 53 that is structured and functions like the compression screw 31 already shown and described herein.

Like the aforesaid roller 18 biasing arrangement, each compression screw 53 is turned into a threaded opening 54 formed in the housing end portion 24, and has a spring guide 55 extending axially into the helical spring 52 to prohibit bending of the spring during compression. As described with respect to the operation of the roller 18 and connected structure, the compression screws 53 can be moved into or out of threaded openings 54 to adjust the compression of the helical spring 52, adjusting thereby the amount of lifting torque that must be applied to elevate the end 35*a* of the toe clamp 35 to the attitude shown in FIG. 6.

Unlike the roller 18, which returns to its original attitude after a displacing torque has been removed therefrom, should the toe clamp 35 be displaced to the attitude shown in FIG. 6, a resetting of the toe clamp and pivot 44 to their starting attitude shown in FIG. 5 will necessitate a counterrotational force as applied by hand, foot or otherwise to rotate it downwardly until the pivot notch flat face 49*a* is again in butting engagement against the face of the piston 50.

The first preferred embodiment of the binding 10 of the present invention heretofore described assumes that a means such as a heel clamp is provided for urging the ski boot heel, not shown, forward so that toe plate 15 on boot sole 13 is forced against the kick plate upturned lip 20. The roller 18 of the binding 10 is thereby urged against the biasing of the spiral spring 29 into engagement with the surface of the notch 17 to prevent the ski boot toe from rotating across the ski 11. In this attitude, the pair of toe clamps 35, are each positioned with their ends 35*a* above the toe plate 15, to prohibit the boot sole 13 from lifting away from the ski 11. Each toe clamp 35 is biased through a pivot 44 by helical springs 52 to maintain nodes 35 arranged of the undersides of the toe clamp ends 35*a* against the top of the toe plate 15.

The biasing of the helical springs 29 and 52 are intended to provide sufficient forces to retain the respective roller 18 and toe clamps 35 against the toe plate 15. Such biasing force of each helical spring is, in turn, adjustable by turning appropriately compression screws 31 and 53 into or out of apertures 32 and 54, respectively, formed in the housing end portion 24. The helical springs 29 and 52 are thereby set to provide a resistive force sufficient to prohibit release of ski boot 12 from the binding 10 during normal skiing activities. Should, however, a certain force or torque, either lateral or vertical to the ski, be applied to the boot 12 as in a fall, then the compressive force exerted by a particular helical spring or springs will be overcome to release the boot 12 from the ski 11.

The first embodiment of the present invention involves a single roller 18 and connected components having a pair of toe clamps 35 and connected components arranged alongside thereof. It should, of course, be apparent that a single toe clamp with roller arrangements along either side could be substituted without departing from the subject matter coming within the scope of the invention. Such arrangement is shown in FIG. 7 and described below as a second preferred embodiment of the present invention.

FIG. 7 shows a top elevation view, like that of FIG. 3, of an adjustable release binding 55. Like the binding 10 shown in FIG. 3, binding 55 has had a top portion or cover removed from a housing 56 thereof, exposing the binding interior and component parts. The binding 55 should be understood to be like the earlier described binding 10 with the exception that, rather than having one roller it has two rollers 57, and, rather than having two toe clamps 35, the binding 55 has only one toe clamp 58. The rollers 57 of this embodiment, like the described roller 18, and components connected thereto are each axially connected across the ends of plungers 59 on whose opposite ends are ranged pistons 60. The pistons 60, in turn engage the ends of helical springs 61 whose opposite ends are maintained by compression screws 62. The compression screws 62 have spring guides 63 that extend therefrom into the helical springs 61, and are turning into threaded holes 64 formed in the end portion 55*a* of the housing 56.

Each described binding component of the rollers 57, it should be understood, is intended to function like those described with respect to roller 18.

A toe plate 64, FIG. 7, like the earlier described toe plate 15, is attached to a ski boot 65 sole 66 by screw 64*a*. The toe plate 64 is intended to be like the described toe plate 15 with the exception that it has two notches 67 formed therein to accomodate the two rollers 57 of this embodiment.

The described rollers 57, of course, function individually like the single roller 18 of the binding 10, releasing the boot 65 should a rotational torque be applied thereto that is sufficient to overcome the biasing by helical springs 63. The toe clamp 58, like the toe clamps 35 of the first binding 10, is mounted by a screw 58 to be vertically adjustable between side walls 69*a* and 69*b* to accommodate various thicknesses of boot soles 66 thereunder. The side walls 69*a* and 69*b*, like side walls 37*a* and 37*b* of the binding 10, are secured opposite to the clamp 58 to a pivot 70, that is arranged to rotate within the housing 56, and has a notch 71 formed therein. The notch 71, like the notch 44 of the binding 10, receives piston 72 therein. The piston 72 is biased into engagement with said notch 71 by a helical spring 73 that is contained within the housing 56 by a compression screw 74. The compression screw 74, like the compression screws 62, can be turned into or out of the housing to effect the adjustment of the compression of the helical spring 73. The single toe clamp 64 of binding 55 therefore functions like the individual toe clamps 35 of the described binding 10 and has the same component parts.

FIG. 8 depicts still another means for achieving the pivot 44 described above in connection with FIGS. 5 and 6. Instead of each pivot 44 having a flat face 49*a* disposed centrally thereof as shown in FIGS. 5 and 6, an alternative embodiment has a pivot 75 with a concave face 76 adapted to receive and hold a sphere 77 which takes the place of the end of piston 50 in FIGS. 5 and 6. Sphere 77 is urged against pivot 75 through biasing means comprising a helical spring 78 and a compression screw 79 adapted to function similarly to the biasing means shown in FIGS. 5 and 6.

The described bindings 10 and 55 illustrate variations of the combination of roller and toe clamp arrangements having the function of retaining a ski boot toe to a ski during normal skiing operations, but are capable of releasing that boot should either a rotating or lifting torque be applied on the boot toe. It should be obvious that the invention described by these two embodiments resides therefore in the combination of the roller and toe clamp arrangements and is not limited to the particular combination shown. Further, as mentioned earlier, herein, a single roller arrangement like that described could be used alone to efficiently maintain a ski boot toe onto a ski, releasing that boot from the ski should a torque be applied against the foot tending to rotate it off the ski.

Although preferred embodiments of my invention have been herein disclosed, it is to be understood that the present disclosure is made by way of example and that variations are possible without departing from the subject matter I regard as my invention.

I claim:

1. An adjustable release ski binding comprising a housing arranged for attachment to a conventional snow ski;

means for attaching said housing to said ski;

roller means arranged to extend outwardly from said housing to engage the forward end of the sole of a conventional ski boot when in position on a ski;

biasing means arranged within said housing for urging said roller means outwardly from said housing;

means for adjusting the amount of biasing force said biasing means exerts against said roller means;

clamp means extending outwardly from said housing disposed alongside said roller means, and arranged to pivot vertically from an attitude above and parallel to said conventional snow ski to an upright attitude with respect to said conventional snow ski and having a clamp member to engage the top surface of the boot sole at the forward end thereof;

means for biasing said clamp means to the attitude above and parallel to said conventional snow ski; and means for adjusting the biasing force exerted by said biasing means tending to maintain said clamp means in said attitude above, and parallel to said conventional snow ski.

2. An adjustable release ski binding as recited in claim 1, wherein the roller consists of a roller axially connected to rotate freely in the plane of the ski;

a plunger having said roller axially connected to one end thereof, which plunger is sliceably arranged in the housing;

a piston secured to the end of said plunger opposite to said roller; and a spring arranged in said housing to bias said piston so as to urge said piston and plunger outwardly therefrom;

3. An adjustable release ski binding as recited in claim 2, wherein the roller is fabricated from a resilient material; and a toe plate is provided for attachment to the toe of the ski boot and has a notch formed therein to receive said roller.

4. An adjustable release ski binding as recited in claim 2, wherein the means for adjusting the biasing force consists of a compression screw turned into the housing capable of being turned to move the opposite end thereof against the spring, changing thereby the compressive force of said spring acting against the piston.

5. An adjustable release ski binding as recited in claim 1, including clamp means extending outwardly from said housing disposed alongside said roller means, and arranged to pivot vertically from an attitude above and parallel to said conventional snow ski to an upright attitude with respect to said conventional snow ski;

means for biasing said clamp means to the attitude above and parallel to said conventional snow ski; and means for adjusting the biasing force exerted by said biasing means tending to maintain said clamp means in said attitude above, and parallel to said conventional snow ski.

6. An adjustable release ski binding as recited in claim 1, wherein the means for adjusting the biasing force exerted by the biasing means against said roller means and clamp means consists of, compression screws each turned into the housing, each having one end thereof extending from said housing that is capable of being turned by an operator to move the opposite end thereof against the biasing means arranged opposite thereto so as to change the compressive force of said biasing means.

7. An adjustable release ski binding as recited in claim 1, wherein the clamp consists of a flat tab having a rounded apex that extends out and over the conventional snow ski;

side walls to receive the end of said flat tab opposite to said apex; and a pivot rotatably arranged in the housing, to which pivot are secured the ends of said side walls, said pivot having a notch in a center portion thereof.

8. An adjustable release ski binding; as recited in claim 1, wherein the means for biasing said roller means consists of a piston slideably arranged in the housing such that one end thereof abuts the roller means;

a spring arranged in said housing having one end thereof abutting the opposite end of said piston, said spring being arranged to be compressed in said housing so as to act upon said clamp means to resist a vertical rotation thereof.

9. An adjustable release ski binding as recited in claim 1, wherein a pair of clamp means, means for biasing each such clamp means, and means for adjusting the biasing force for each clamp means are included, each clamp means being arranged along opposing sides of the roller means.

10. An adjustable release ski binding as recited in claim 1, wherein a pair of roller means, means for biasing each such roller means, and means for adjusting the biasing force for each roller means are included, each roller means being arranged along opposing sides of the clamp means.

* * * * *